US006231454B1

(12) United States Patent
Teramoto

(10) Patent No.: US 6,231,454 B1
(45) Date of Patent: May 15, 2001

(54) GOLF CLUBS AND GOLF CLUB SETS

(75) Inventor: Seiichiro Teramoto, Gyoubashi (JP)

(73) Assignee: Aneeging Sports Co., LTD (JP)

( * ) Notice: Subject to any disclaimer, the term of this patent is extended or adjusted under 35 U.S.C. 154(b) by 0 days.

(21) Appl. No.: 09/239,564

(22) Filed: Jan. 29, 1999

(30) Foreign Application Priority Data

Mar. 25, 1998 (JP) ..... 10-078107

(51) Int. Cl.[7] ..... A63B 53/00
(52) U.S. Cl. ..... 473/289; 473/290
(58) Field of Search ..... 473/289, 290

(56) References Cited

U.S. PATENT DOCUMENTS 3,948,042 * 4/1976 Beardsley .
4,000,896 * 1/1977 Lauraitis ..... 473/319
4,070,022 * 1/1978 Braly ..... 473/289
4,135,035 * 1/1979 Branen .
4,563,007 * 1/1986 Bayliss .
4,600,215 * 7/1986 Kuroki .
4,682,504 * 7/1987 Kobayashi .
4,900,025 * 2/1990 Suganuma ..... 472/289
5,351,951 * 10/1994 Hodhetts .
5,547,426 * 8/1996 Wood ..... 473/290
5,591,091 * 1/1997 Hackman ..... 473/289
5,731,524 * 3/1998 Matsumoto .

FOREIGN PATENT DOCUMENTS 9-164225 * 6/1997 (JP) .

* cited by examiner

*Primary Examiner*—Jeanette Chapman
*Assistant Examiner*—Stephen L. Blau
(74) *Attorney, Agent, or Firm*—Baker & Daniels

(57) ABSTRACT

A golf club set in which the attenuation rate of torque oscillation of club shafts is optimized for every individual club. The attenuation rate of torque oscillation of club shafts is controlled so as to be larger as the corresponding loft angles of the clubs increase.

2 Claims, 6 Drawing Sheets

| LOFT ANGLE (° ) | ATTENUATING RATE OF TORQUE OSCILLATION |
|---|---|
| 10 | 0.040 |
| 15 | 0.044 |
| 20 | 0.048 |
| 25 | 0.052 |
| 30 | 0.056 |
| 35 | 0.060 |
| 40 | 0.064 |
| 45 | 0.068 |
| 50 | 0.072 |
| 55 | 0.076 |

Fig. 4

| LOFT ANGLE (° ) | ATTENUATING RATE OF TORQUE OSCILLATION |
|---|---|
| 10 | 0. 040 |
| 15 | 0. 044 |
| 20 | 0. 048 |
| 25 | 0. 052 |
| 30 | 0. 056 |
| 35 | 0. 060 |
| 40 | 0. 064 |
| 45 | 0. 068 |
| 50 | 0. 072 |
| 55 | 0. 076 |

GOLF CLUBS AND GOLF CLUB SETS

RELATED APPLICATION

This application claims the priority of Japanese Patent Application No. H10-78107, filed Mar. 25, 1998, the complete disclosure of which is expressly incorporated herein by reference.

TECHNICAL FIELD

The present invention relates to golf clubs and golf club sets, and more particularly to golf club sets in which the attenuation rate of torque oscillation of club shafts is optimized for each individual club.

BACKGROUND ART

In recent years, golf clubs have been improved remarkably. In many cases, club heads are designed in order to broaden their sweet spots or to lower their centers of gravity. For the shafts of golf clubs, new materials are being used to control flexibility or strength against twist.

DISCLOSURE OF THE INVENTION

According to other features, characteristics, embodiments and alternatives of the present invention which will become apparent as the description thereof proceeds below, the present invention provides golf club sets in which the attenuation rate of torque oscillation of the club shafts is optimized for each individual club.

According to the present invention, golf clubs are designed so as to produce optimized or improved perform characteristics for each individual club for golfers of all levels of experience, from beginners or novice to professional golfers.

The present invention is applicable to both woods and irons.

According to a first aspect of the invention, in golf club sets, the attenuation rate of torque oscillation of individual club shafts is controlled so as to increase proportionally with correspondingly increasing loft angles.

According to a second aspect of the invention, golf clubs are characterized by controlling rate of torque oscillating attenuation of the club shafts.

Additional objects, advantages and novel features of the invention will be set forth in the description that follows, and will otherwise become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF DRAWINGS

The present invention will be described hereafter with reference to the attached drawings which are given as non-limiting examples only, in which:

FIG. 4 is a table showing an example of the attenuation rate of torque oscillation according to an embodiment of the present invention.

BEST MODE FOR CARRYING OUT THE INVENTION

In golf club sets, each individual club is required to have separate characteristics. That is, it is required, for long (less-lofted) clubs, such as drivers, to effect a long driving distance. On the other hand, shorter (more-lofted) clubs, such as a pitching wedge, are required to have accuracy both in direction and distance.

Figure 1:
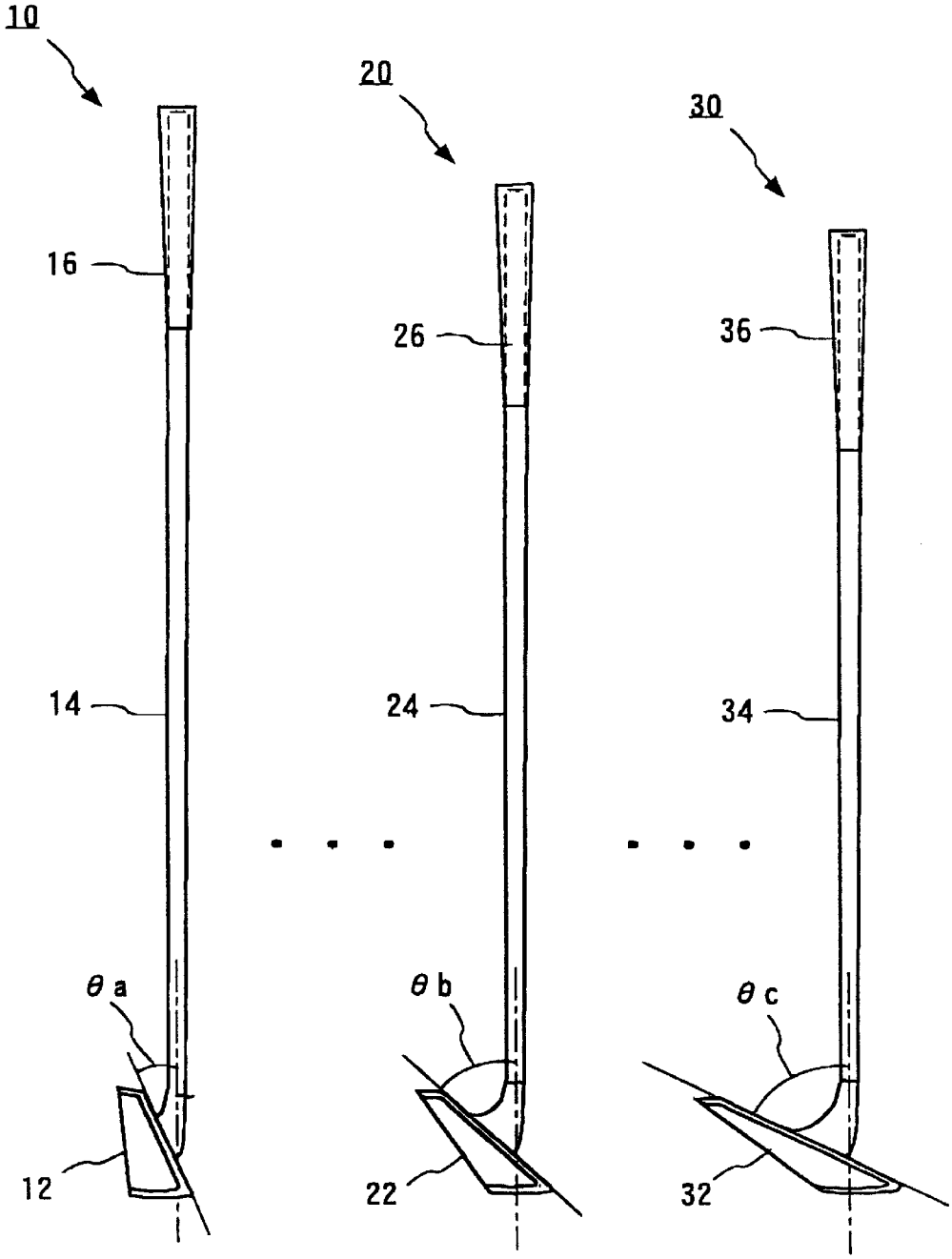
FIG. 1 is a plan view illustrating an iron set designed according to one embodiment of the present invention.

FIG. 1 shows a golf club set to which the present invention is applied. The golf club set includes a long iron 10 having a small loft angle of θa, a middle iron 20 having a medium loft angle of θb and a short iron 30 having a large loft angle of θc. The golf club set may include other clubs having different loft angles. In FIG. 1, a loft angle indicates the angle formed by the central line of a shaft and the face of a club head.

In FIG. 1, the long iron 10 includes a head 12 having a face with a loft angle θa, a grip 16 which a player grasps, and a shaft 14 which connects the head 12 and the grip 16. In the same manner, the middle iron 20 includes a head 22 having a face with a loft angle θb, a grip 26 which a player grasps, and a shaft 24 which connects the head 22 and the grip 26. The short iron 30 includes a head 32 having a face with a loft angle θc, a grip 36 which a player grasps, and a shaft 34 which connects the head 32 and the grip 36. The present invention optimizes the attenuation rate of torque oscillation of shafts of golf clubs.

Figure 2:
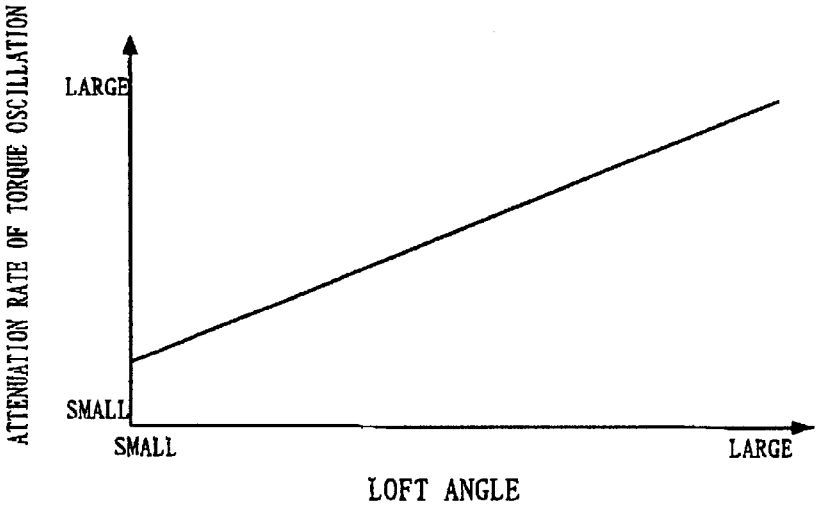
FIG. 2 is a graph showing the attenuation rate of torque oscillation of a shaft relative to loft angle, according to one embodiment of the present invention.

FIG. 2 is a graph showing the attenuation rate of torque oscillation of a shaft relative to loft angle, according to one embodiment of the present invention. In the graph shown in FIG. 2, the horizontal axis represents loft angles and the vertical axis represents the attenuation rate of torque oscillation. For purposes of the present application "torque oscillation" means oscillation that occurs when the shaft is twisted and released. "Attenuation rate of torque oscillation" means the natural return of the torque angle (twist angle) to the original state. Commensurate with these definitions, it can be understood that it is hard to recover a twist of a shaft when the attenuation rate of torque oscillation is small. On the other hand, it is easy to recover a twist of a shaft when the attenuation rate of torque oscillation is large.

As shown in FIG. 2, the attenuation rate of torque oscillation is smaller for longer clubs and is larger for shorter clubs.

Figure 3:
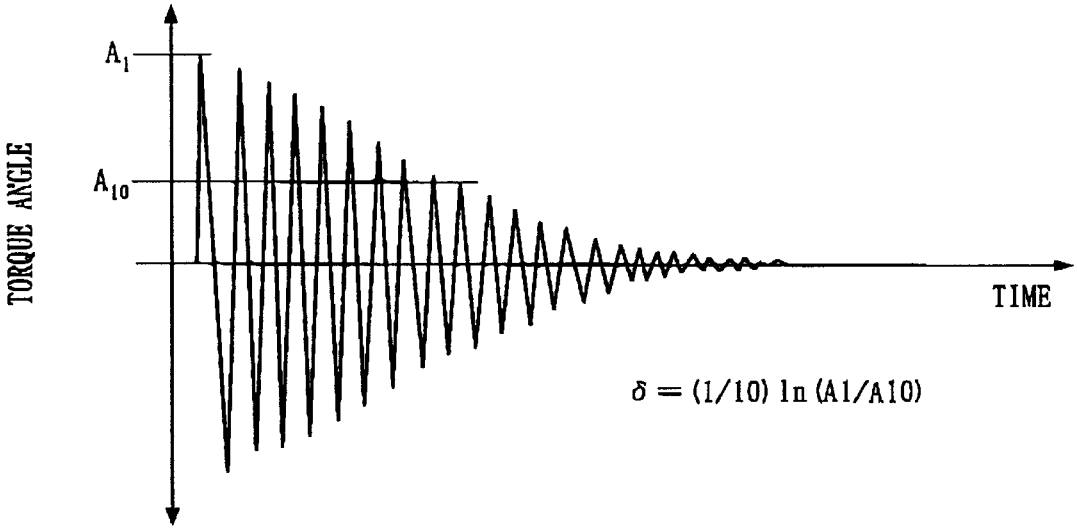
FIG. 3 is a graph showing torque oscillation of a shaft that attenuates over time.

FIG. 3 is a graph showing how torque oscillation of a shaft is attenuated. In the graph shown in FIG. 3, the horizontal axis represents time and a vertical axis represents torque angle (amplitude). When measuring the torque angle in FIG. 3, the shaft was fixed at its head-side end and 35 mm from the grip-side end. In this condition, a 1.4 kg load was applied to the shaft at a radial position 35 mm away from the head-side end. Then, change of a torque angle of the shaft was measured. The attenuation rate of torque oscillating (δ) was obtained by the following formula:

$$\delta=(1/10)\ \ln\ (A1/A10)$$

where "A1" represents the peak of the initial vibration and "A10" represents the peak of the 10th oscillation (Vibration) from the initial vibration A1.

The attenuation rate of torque oscillation can be obtained not only by measuring peaks of oscillation but also by measuring a time between two points.

As shown in FIG. 2, a longer club having a small loft angle is provided with a shaft having an attenuation rate of torque oscillation which is small. The shaft of such a longer club feels soft to a player during a swing and may make long drive. A shorter club having a large loft angle is provided with a shaft in which the attenuation rate of torque oscillation is large. The shaft of such a shorter club feels hard or stiff and more sensitive to a player during a swing and the player may have a more delicate control of the ball.

FIG. 4 is a table showing an example of the attenuation rate of torque oscillation according to an embodiment of the present invention. FIG. 4 shows an example of values of attenuation rate of torque oscillation. As shown in FIG. 4, for a club having a loft angle of 10 degrees, the attenuation rate of torque oscillation of a shaft is 0.04. As the loft angle increases by 5 degrees, the attenuation rate of torque oscillation increases by about 10% (0.004). For a club having a loft angle of 55 degrees, the attenuation rate of torque oscillation is 0.076. The values shown in FIG. 4 are exemplary. In some cases the attenuation rate of torque oscillation may be non-linear. For example, two or more clubs, which have different loft angles, can have similar attenuation rates of torque oscillation.

Figure 5:
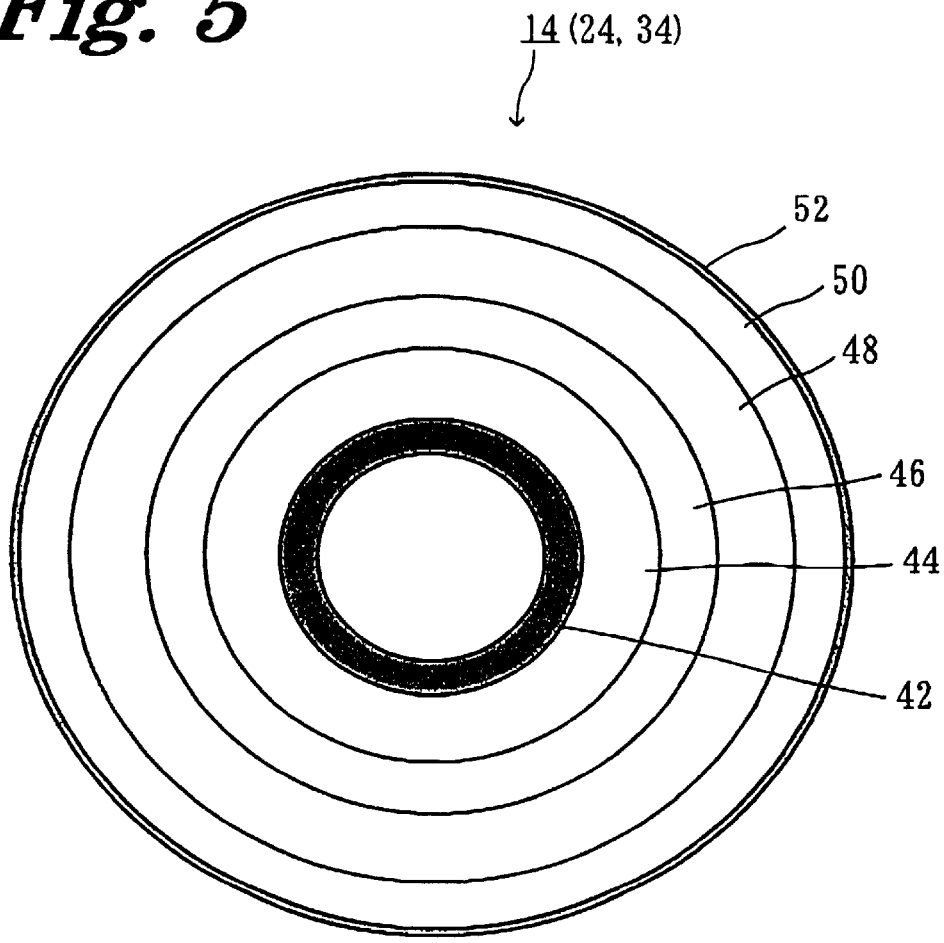
FIG. 5 is a cross-sectional view showing the internal structure of a shaft according to one embodiment of the present invention.

FIG. 5 is a cross-sectional view showing the internal structure of a shaft according to one embodiment of the present invention. FIG. 5 shows the inside of a shaft. The shaft 14 (24, 34) includes a core 42, and layers 44, 46, 48 and 50, and a paint tunic 52 formed on the outer surface. Each of the layers 44, 46, 48 and 50 is formed to have a thickness of about 100–200 microns. The total thickness of these layers is about 500 microns or more. The layers 44, 46, 48 and 50 are made of a material of the poly-acrylonitrile (PAN) system. The materials from which layers 44, 46, 48 and 50 are formed can be prepared by adding thermosetting resin or epoxy resin to carbon fibers and then causing the material to half-set. Fibers forming the layers 44 and 46 are so-called straight layers. Fibers forming such straight layer can be applied to the shaft so that they extend longitudinally with respect to the shaft. The layer 48 can be a bias layer. Fibers forming the layer 48 are wound in a spiral manner around the shaft.

In order to regulate the attenuation rate of torque oscillation of the shafts, glass mats, aramid fibers (polyamide fibers), urethane films, etc. may be used. The attenuation rate of torque oscillation of the shafts can be controlled by regulating the bias layer 48. The attenuation rate of torque oscillation of the shafts can also be controlled by the interfacial condition between adjacent layers, and the manufacturing conditions, including temperature and humidity.

In general, the attenuation rate of torque oscillation of boron fibers is small and the attenuation rate of torque oscillation of glass fibers is large. In order to increase the attenuation rate of torque oscillation for purposes of the present invention, the glass-fiber layer 50 is used and the boron-fiber layer 46 is not used. Conversely, in order to decrease the attenuation rate of torque oscillation for purposes of the present invention, the glass-fiber layer 50 is not used and the boron-fiber layer 46 is used. According to further embodiments of the present invention the attenuation rate of torque oscillation can be controlled by using both glass-fiber layer 50 and boron-fiber layer 46 and the respective thickness of each layer is controlled or adjusted. In some embodiments these layers can be applied so that their thicknesses increase or decrease along the length of a club shaft to effect a desired attenuation rate of torque oscillation. In addition, to control the attenuation rate of torque oscillation, the position and the area on which a glass-fiber layer is formed may be controlled, as indicated in FIG. 6.

Figure 6:
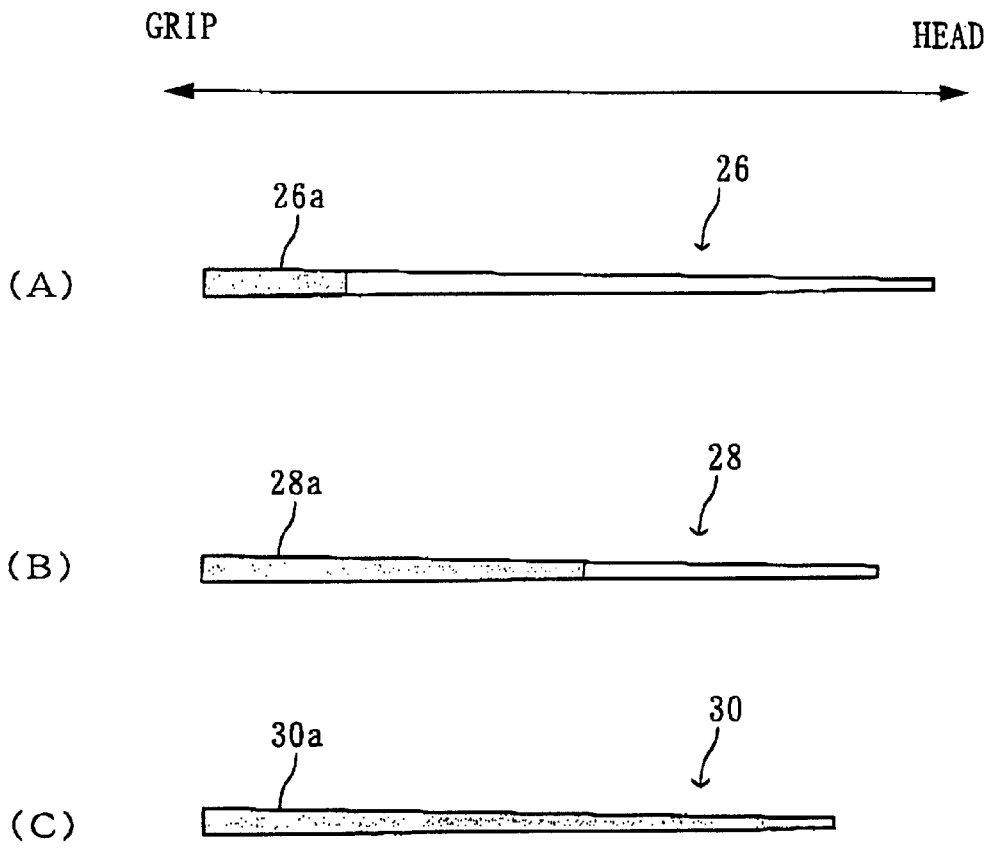
FIG. 6 shows one manner of regulating the attenuation rate of torque oscillation according to the present invention, in which (A) is for a long club, (B) is for a medium length club, and (C) is for a short club.

FIG. 6 shows one manner of regulating the attenuation rate of torque oscillation according to the present invention, in which (A) is for a long club, (B) is for a medium length club, and (C) is for a short club. As shown in FIG. 6 (A), for a shaft of a longer club, a glass-fiber layer is formed over a core 26 only along a short length or portion 26*a* of the shaft from the grip-side end. As shown in FIG. 6 (C), for a shaft of a shorter club, a glass-fiber layer is formed over a core 30 along the entire length 30*a*. As shown in FIG. 6 (B), for a shaft of a medium length club, a glass-fiber layer is formed over a core 28 along a length or portion 28*a* of the shaft which extends from the grip side-end to about the center of the shaft. The core of a shaft may be of iron or other suitable metal.

In a manner which can be considered as symmetrical to the arrangement depicted in FIG. 6 is possible to proceed according to the following setup when using a material with a small attenuation rate of torque oscillation. For the shaft of a longer club, a boron-fiber layer can be formed over the shaft core along the entire length of the club shaft. For a shaft of a shorter club, a boron-fiber layer can be formed over the shaft core along a short length or portion of the shaft from a grip-side end. For a shaft of a medium length club, a boron-fiber layer can be formed over the shaft core along a length or portion of the shaft from the grip-side end to near the center of the shaft.

Figure 7:
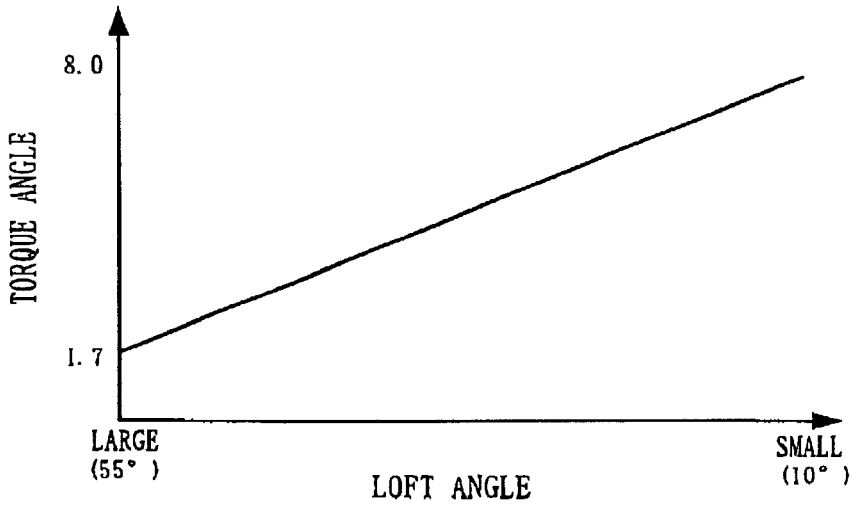
FIG. 7 is a graph that shows torque angle of club shafts relative to corresponding loft angles according to one embodiment of the present invention.

FIG. 7 is a graph that shows torque angle of club shafts relative to corresponding loft angles according to one embodiment of the present invention. FIG. 7 shows the characteristic of a torque angle (twist angle). As shown in FIG. 7, a golf club having a larger loft angle is equipped with a shaft with a smaller torque angle. A golf club having a smaller loft angle is equipped with a shaft with a larger torque angle.

When measuring the torque angle in FIG. 7, the shaft was fixed at the head-side end and 35 mm from the grip-side end. In this condition, a one ounce load was applied to at a radial position one foot away from the head-side end. A torque angle was measured when the shaft was completely twisted.

In order to measure a torque angle of a shaft, a laser sensor can be used. The laser sensor can measure torque angle, the attenuation rate of torque oscillation and attenuation time of torque oscillation without contacting the shaft. The use of a laser sensor allows the data to be measured precisely. In addition, a lighter load, such as one pound, can be used in order to avoid any chance of damaging the shaft. When the torque angles of shafts of clubs are controlled and verified by measurements as shown in FIG. 7, the attenuation rate of torque oscillation is controlled according to the present invention, as mentioned above.

That is, the shaft of longer club feels soft to a player during a swing and may make long drive. A shorter club having a larger loft angle is provided with a shaft in which the attenuation rate of torque oscillation is large. The shaft of such a shorter club feels hard or stiff and more sensitive to a player during a swing so that the ball can be controlled accurately both in direction and distance. The present invention enables the characteristics of each club having different loft angles to be improved by controlling both the attenuation rate of torque oscillation and torque angle.

Figure 8:
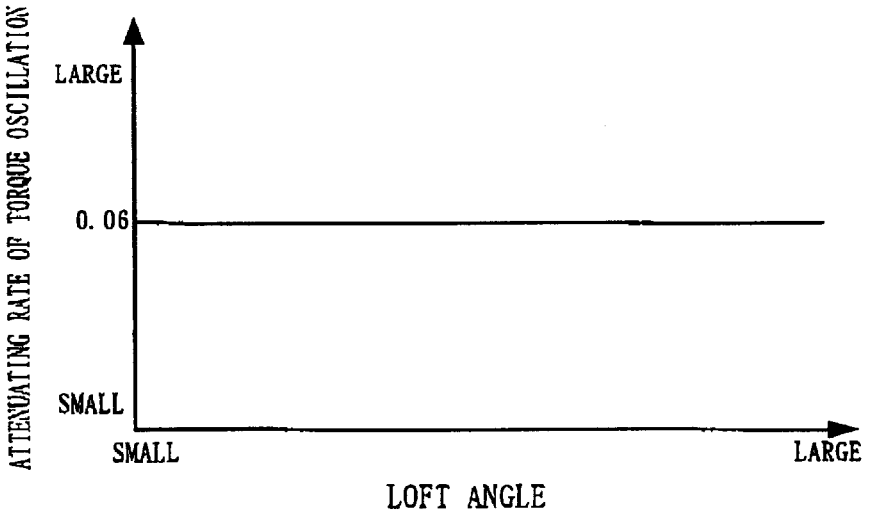
FIG. 8 is a graph showing the attenuation rate of torque oscillation of club shafts relative to corresponding loft angles according to another embodiment of the present invention.

FIG. 8 is a graph showing the attenuation rate of torque oscillation of club shafts relative to corresponding loft angles according to another embodiment of the present invention. In FIG. 8, as the attenuation rate of torque oscillation of the shafts is the same for all clubs in the set. However, a setup shown in FIG. 7 should be adopted for the flow design of the torque angle of a shaft. It is expected that a setup shown in FIG. 8 will be more suitable to low-handicappers and professionals who mainly think club feel is important.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed is:

1. A golf club set comprising a plurality of individual golf clubs having progressively increasing loft angles, wherein each golf club comprises a grip for grasping, a head for hitting a ball, and a shaft connected between the grip and head; and the attenuation rate of torque oscillation of the shaft of each of the individual golf clubs increase as the corresponding loft angles of each of the individual golf clubs, a torque angle of the shaft of each of the individual golf clubs is proportional to the progression of the loft angles.

2. A golf club set comprising a plurality of individual golf clubs having progressively increasing loft angles, wherein each golf club comprises a grip for grasping, a head for hitting a ball, and a shaft connected between the grip and head; and the attenuation rate of torque oscillation of the shaft of each of the individual golf clubs increase as the corresponding loft angles of each of the individual golf clubs, the attenuation rate of torque oscillation of the shaft of the individual golf clubs increases by a unit of about ten percent for each five-degree increase of the loft angle.

* * * * *